US006971192B2

(12) United States Patent
Shepherd

(10) Patent No.: US 6,971,192 B2
(45) **Date of Patent: *Dec. 6, 2005**

(54) PADDED SHOE

(75) Inventor: Steven H. Shepherd, West Palm Beach, FL (US)

(73) Assignee: Ringstar, Inc., New Albany, OH (US)

( * ) Notice: Subject to any disclaimer, the term of this patent is extended or adjusted under 35 U.S.C. 154(b) by 8 days.

This patent is subject to a terminal disclaimer.

(21) Appl. No.: 10/660,964

(22) Filed: Sep. 12, 2003

(65) Prior Publication Data

US 2004/0045196 A1 Mar. 11, 2004

Related U.S. Application Data

(60) Continuation-in-part of application No. 10/194,777, filed on Jul. 12, 2002, now abandoned, which is a continuation of application No. 10/158,478, filed on May 30, 2002, now abandoned, which is a division of application No. 09/593,256, filed on Jun. 13, 2000, now Pat. No. 6,408,542.

(60) Provisional application No. 60/165,548, filed on Nov. 15, 1999.

(51) Int. Cl.[7] ..... A43B 23/26; A43B 13/14; A43B 5/00

(52) U.S. Cl. ..... 36/54; 36/99; 36/71; 36/72 R; 36/114

(58) Field of Search ..... 36/54, 99, 71, 36/72 R, 114, 133, 93, 55, 50.1

(56) References Cited

U.S. PATENT DOCUMENTS 312,675 A * 2/1885 Turner
806,267 A * 12/1905 King
830,753 A 9/1906 Voss
2,139,858 A 12/1938 Schwartz et al.
2,915,837 A * 12/1959 Schlecht
3,284,931 A 11/1966 Dassler
3,379,722 A 4/1968 Manson et al.
3,583,081 A 6/1971 Hayashi
3,650,051 A 3/1972 Sass
RE27,512 E 10/1972 Onitsuka
3,703,775 A * 11/1972 Gatti ..... 36/128
3,949,493 A 4/1976 Rhee
4,051,613 A 10/1977 Collins
4,065,861 A 1/1978 Pelfrey
4,361,970 A 12/1982 Wren, Jr. et al.
4,372,060 A 2/1983 Adamik
4,377,913 A 3/1983 Stone
4,451,995 A * 6/1984 Antonious ..... 36/51
4,495,715 A 1/1985 Fredrickson et al.
4,547,981 A 10/1985 Thais et al.

(Continued)

FOREIGN PATENT DOCUMENTS

GB 2257893 * 1/1993

*Primary Examiner*—M. D. Patterson
(74) *Attorney, Agent, or Firm*—Akerman Senterfirr

(57) ABSTRACT

A padded shoe includes a flexible, resilient sole having a substantially outer surface. A shoe upper is adjoined to the sole, the shoe upper having closed-cell foam padding disposed therein. The shoe upper includes a padded tongue including an inner tongue portion and an outer padded tongue portion. Fastening structure retains the shoe on the foot of a wearer. Engagement structure is included for securing the outer padded tongue to cover the inner tongue portion. The outer padded tongue portion substantially covers the engagement structure. The wearer can strike a target with the shoe, and the target and the wearer are protected from injury caused by direct impact with the fastening structure and the engagement structure.

26 Claims, 7 Drawing Sheets

U.S. PATENT DOCUMENTS

| | | | | |
|---|---|---|---|---|
| 4,624,015 | A | 11/1986 | Bottoms | |
| 4,769,928 | A | 9/1988 | Ward | |
| 4,972,609 | A | 11/1990 | Oh et al. | |
| 5,117,568 | A | 6/1992 | Mitsui | |
| 5,154,011 | A | 10/1992 | Holzl et al. | |
| 5,211,672 | A | 5/1993 | Andujar | |
| 5,337,493 | A | 8/1994 | Hill | |
| 5,430,960 | A | 7/1995 | Richardson | |
| 5,701,688 | A * | 12/1997 | Crowley | 36/72 R |
| D433,212 | S | 11/2000 | Morle | |
| 6,408,542 | B1 * | 6/2002 | Shepherd | 36/54 |
| 2002/0029496 | A1 * | 3/2002 | Morle | 36/99 |

* cited by examiner

PADDED SHOE

CROSS REFERENCE TO RELATED APPLICATIONS

This application is a continuation-in-part application of U.S. patent application Ser. No. 10/194,777, filed Jul. 12, 2002, now abandoned which was a continuation of U.S. patent application Ser. No. 10/158,478 filed May 30, 2002, now abandoned which was a divisional of U.S. patent application Ser. No. 09/593,256 filed Jun. 13, 2000, now U.S. Pat. No. 6,408,542, which claims the benefit of U.S. Patent Provisional Application No. 60/165,548, filed on Nov. 15, 1999.

STATEMENT REGARDING FEDERALLY SPONSORED RESEARCH OR DEVELOPMENT (Not Applicable)

BACKGROUND OF THE INVENTION

1. Field of the Invention

The present invention relates to footwear, and more particularly to a padded shoe designed for use in athletic activities such as kickboxing and other martial arts.

2. Description of the Related Art

The foot can be subjected to stresses during athletic activities. Existing athletic shoes, such as those disclosed by Thais et al., U.S. Pat. No. 4,547,981, Richardson, U.S. Pat. No. 5,430,960, Onitsuka, U.S. Pat. No. Re. 27,512, and Mitsui, U.S. Pat. No. 5,117,568, are primarily constructed to provide support for the arch and ankles of the wearer while running or jumping. In addition to running and jumping, some sports and fitness activities require the participant to engage in kicking maneuvers, such as martial arts and soccer. The top, sides, sole, and heel of the feet can sustain severe blows during such activities. Additionally, kicks can be landed against another person during certain activities, either inadvertently or, in the case of the martial arts, while sparring. There is a possibility that the impact of knotted shoe laces or other shoe fastening structure can injure the participants during athletic activities such as sparring. It is therefore desirable to provide a shoe which protects from such injuries during activities such as martial arts and kick boxing.

Prior art sports shoes are generally manufactured using open cell foams. These foams are very soft, and offer a great deal of comfort to the wearer, but because of their softness they do not offer any protection to the wearer from injury sustained in kicking or striking. Typically, where it is desired to offer protection of this sort, the outer fabric of the shoe, which may be leather or a synthetic leather, is reinforced with a rigid or semi-rigid material. The reinforcing material thus receives the force of an impact, while the open cell foam cushions the wearer from the reinforcing material. However, the reinforcing material imparts rigidity to the shoe, and causes greater injury to an opponent than an unreinforced shoe. This type of arrangement is thus not suitable for use in sports such as the martial arts.

Prior art shoes adapted to prevent injury from kicking to both the wearer and an opponent are generally those designed specifically for use in the martial arts. Such shoes are known to have significant limitations. For example, such shoes generally do not have a shoe lacing arrangement. As a lacing arrangement often provides the greatest degree of support for the ankle of the wearer, prior art martial arts shoes generally do not have the ankle support that is found in many athletic shoes. In addition, conventional martial arts shoes are generally not suitable for street wear.

Another limitation of conventional shoes for use in activities involving kicking, such as kick boxing and martial arts, involves the padding used throughout the shoe. For example, martial arts shoes disclosed in Oh et al., U.S. Pat. No. 4,972,609, Frederickson et al., U.S. Pat. No. 4,495,715, Wren, Jr., et al., U.S. Pat. No. 4,361,970, and Rhee, U.S. Pat. No. 3,379,722 disclose foot protectors which are little more than foam pads strapped to the foot.

U.S. Pat. No. 5,211,672 to Andujar discloses a protective shoe for use in contact sports such as martial arts. In the Andujar reference, the shoe upper is constructed of foam, and includes additional protective pads on its ankle and top portions. The shoe is secured by a single elastic strap held in place by Velcro® fasteners. This fastening system would not provide a significant amount of support to the ankles of the wearer, and could easily slip and become displaced, causing the wearer to become unbalanced. Collins, U.S. Pat. No. 4,051,613, similarly discloses a padded boot for use in the martial arts. This shoe is also secured by a single elastic strap with Velcro® fasteners.

Rhee, U.S. Pat. No. 3,949,493, discloses a protective shoe constructed of energy absorbing resilient material and a substantially open bottom. The open bottom allows the foot of the wearer to contact the floor or the ground. The shoe designed by Rhee is for use only in a gym or sparring ring, and is obviously unsuitable for everyday wear.

Bottoms, U.S. Pat. No. 4,624,015, discloses a karate and kickboxing protective boot which has an open back and a detachable heel protector portion. This boot is designed strictly for use in a sparring ring.

Ward, U.S. Pat. No. 4,769,928, discloses a slip-on type shoe for use in the martial arts. This shoe is constructed of a lightly padded material. Ward does not disclose the use of heavy padding positioned on the foot so as to absorb the impact of a kick against a kicking bag or opponent.

It would be advantageous to provide a shoe which is adapted for activities involving kicking that can protect a wearer of the shoe and/or a partner from injury, while also providing ankle support to the wearer.

SUMMARY OF THE INVENTION

According to an arrangement of the present invention, a padded shoe includes a flexible, resilient sole having a substantially smooth outer surface. A shoe upper is adjoined to the sole. At least a portion of the shoe upper has closed-cell foam padding disposed therein. The shoe upper includes a padded tongue including an inner tongue portion and an outer padded tongue portion. Fastening structure retains the shoe on the foot of a wearer. Engagement structure is included for securing the outer padded tongue to cover the inner tongue portion. The outer padded tongue portion substantially covers the engagement structure. The wearer can strike a target with the shoe, and the target and the wearer are protected from injury caused by direct impact with the fastening structure and the engagement structure.

The outer tongue portion may be attached to the shoe upper at one side of the shoe, or may be attached to the shoe upper at an end of the tongue. In one arrangement, the outer padded tongue portion may have closed-cell foam padding disposed therein.

In one arrangement, the inner tongue portion may be padded. The inner padded tongue portion may have closed-cell foam padding disposed therein.

The shoe upper may be completely padded, or may have padding to generally correspond to at least one location on the foot of the wearer. The location may include at least one of the group consisting of the forward dorsal region, the top of the foot, the posterior aspect of the heel, the left and right forward lateral aspects of the foot, and the ankle portion.

The closed-cell foam padding in the shoe upper may have a durometer of approximately 0.253. The padding may have a density of between approximately 1.5 pcf and approximately 4.5 pcf, and in one embodiment, the density may be between approximately 1.5 pcf and approximately 3.5 pcf. The padding may have a compression strength of between approximately 3 psi and approximately 23 psi at approximately 25% deflection and a compression strength of between approximately 9 psi and approximately 42 psi at approximately 50% deflection. In one embodiment, the compression strength may be between approximately 6 psi and approximately 22 psi at approximately 25% deflection and a compression strength of between approximately 12 psi and approximately 34 psi at approximately 50% deflection. The padding may have a tensile strength of between approximately 28 psi and approximately 145 psi, and in one embodiment the tensile strength may be between approximately 30 psi and approximately 120 psi. The padding may have a thickness between approximately 0.125 inch and approximately 1 inch. In one embodiment, the padding may have a thickness between approximately 0.25 inch and approximately 0.5 inch. The padding may have a thickness of approximately 0.375 inch.

The sole may have a substantially smooth lower surface. At least a portion of the sole may have a surface pattern thereon. At least a portion of the perimeter of the sole is chamfered. The chamfering may provide a smooth arcuate edge to the sole. The sole may be formed at least partially from EVA. The sole may have a durometer between approximately 0.20 and approximately 0.23.

The fastening structure may be a lace threaded through eyelets disposed on the shoe upper. The engagement structure may include hook and loop fastener material positioned on at least a portion of an underside of the outer tongue portion. The inner tongue portion may be an elastic material, which may also form the fastening structure. The shoe upper may be formed using a Strobel construction.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
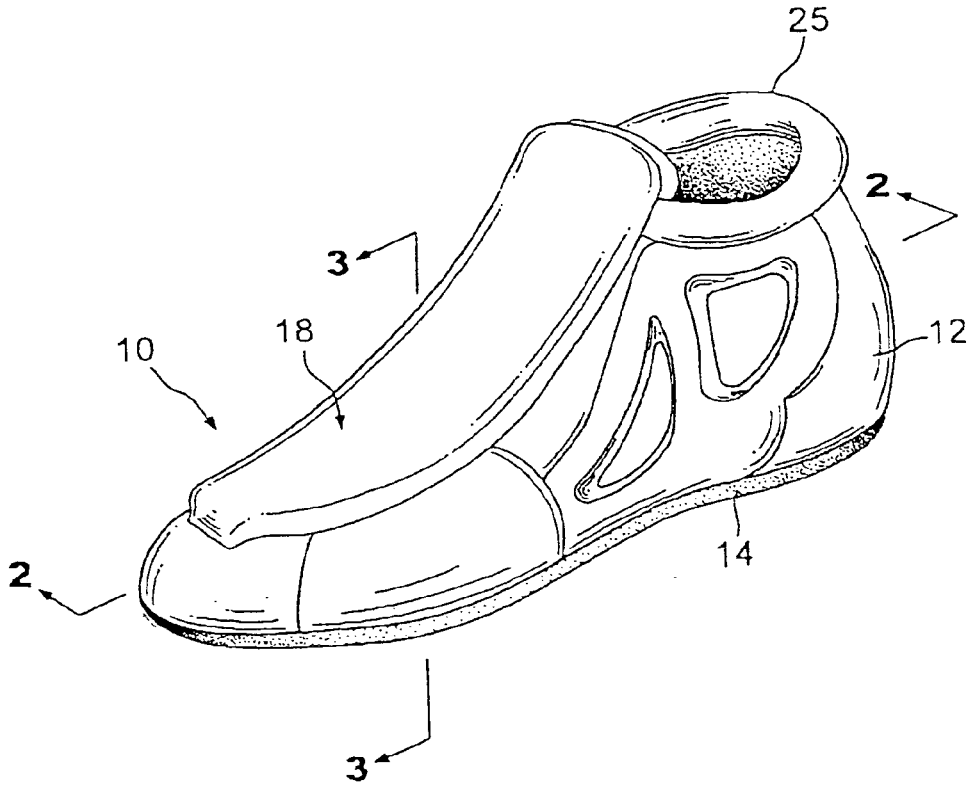
FIG. 1 is a perspective view of a padded shoe according to an embodiment of the invention.

A shoe 10 according to a one embodiment of the invention is illustrated in FIG. 1. The shoe 10 is preferably formed of materials which are light in weight yet still strong and durable. The shoe 10 includes a shoe upper 12 adjoined to a sole 14. The shoe upper 12 can be manufactured from any conventional material such as leather, synthetic leather, or canvas. The shoe upper 12 preferably extends at least to the ankle of the wearer, however, the invention is not limited in that regard. For example, the shoe upper 12 can extend significantly beyond the ankle of the wearer to cover all or a portion of the shin, or not extend to the ankle of the wearer. The upper edge 25 of the shoe upper 12 preferably forms a collar into which a foot can be inserted.

A portion of the edge of sole 14 can be chamfered to provide a continuous arcuate edge at the point where the sole 14 is joined to the shoe upper 12. It is particularly preferable to have chamfered edges at the front toe and rear heel portions of the shoe 10. The sole 14 can be attached to the shoe upper 12 by any means known in the art, such as gluing, stitching, or heat sealing. The shoe upper 10 preferably includes a padded tongue 18, to be discussed in detail hereinafter.

Figure 2:
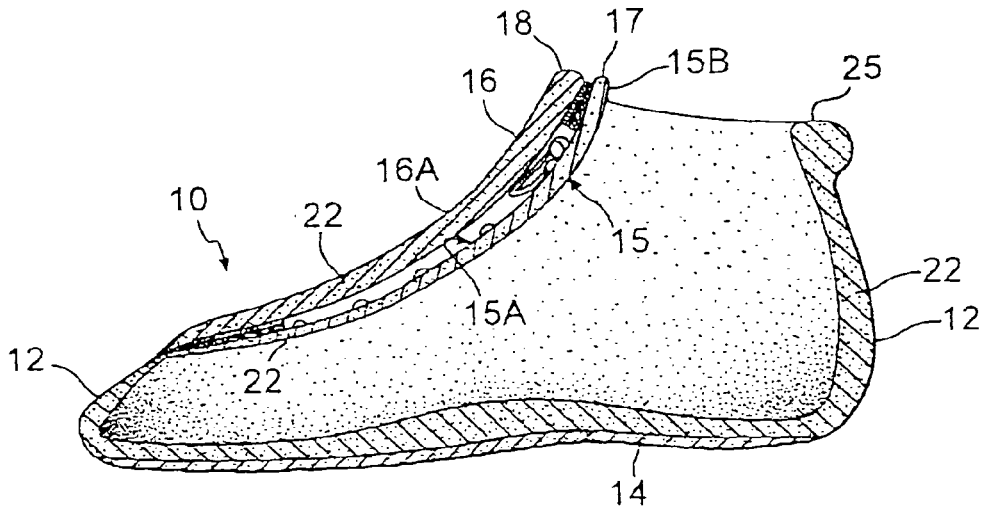
FIG. 2 is a cross-sectional view of the padded shoe in FIG. 1 taken along line 2—2.
Figure 3:
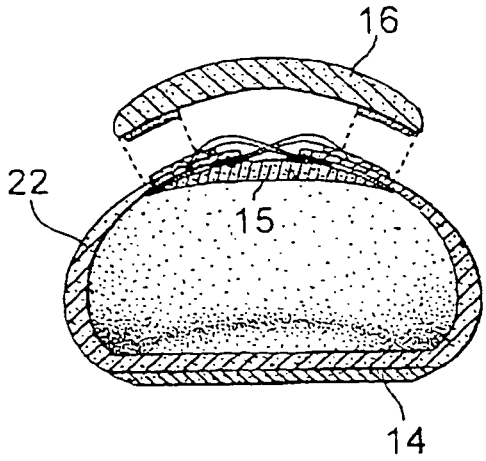
FIG. 3 is a cross-sectional view of the padded shoe in FIG. 1 taken along line 3—3.

As shown in FIGS. 2 and 3, the shoe upper 12 can include any suitable padding material 22 disposed therein. For example, the padding material 22 can be foam rubber, cotton, open-cell foam or closed-cell foam. The padding material 22 preferably has a high degree of resiliency and excellent shock absorption properties. In a particularly preferred embodiment, the padding material 22 is a closed-cell chemically cross-linked polyethylene foam, such as the Minicel® products manufactured by the Voltek Division of the Sekisui America Corporation. Although not limited in this regard, closed-cell foam padded suitable for use in the shoe 10 can have a density of between approximately 1.5 and 3.5 pcf, a compression strength of between approximately 6 and 22 psi at approximately 25% deflection and between approximately 12 and 34 psi at approximately 50% deflection, and a tensile strength of between 30 and 120 psi.

The padding material 22 can be located throughout the shoe upper 12. In a particularly preferred embodiment, the padding material 22 has an increased thickness on those points of the shoe upper 12 which cover portions of the foot that are more likely to be injured during athletic activities involving kicking, such as kick boxing and martial arts. For example, the padding material 22 can have an increased thickness at the portion of the shoe upper 12 that covers the forward dorsal region of the foot, the top of the foot, the posterior aspect of the heel, the left and right forward lateral aspects of the foot, or the ankle portion. The ankle portion can be defined as the area which generally surrounds the medial malleolus and the lateral malleolus and the area therebetween. The padding material 22 can have any suitable thickness, but preferably has a thickness of between approximately 0.125 and 1.0 inches throughout the shoe 10, and most preferably has a thickness of between 0.25 and 0.5 inches.

Figure 4:
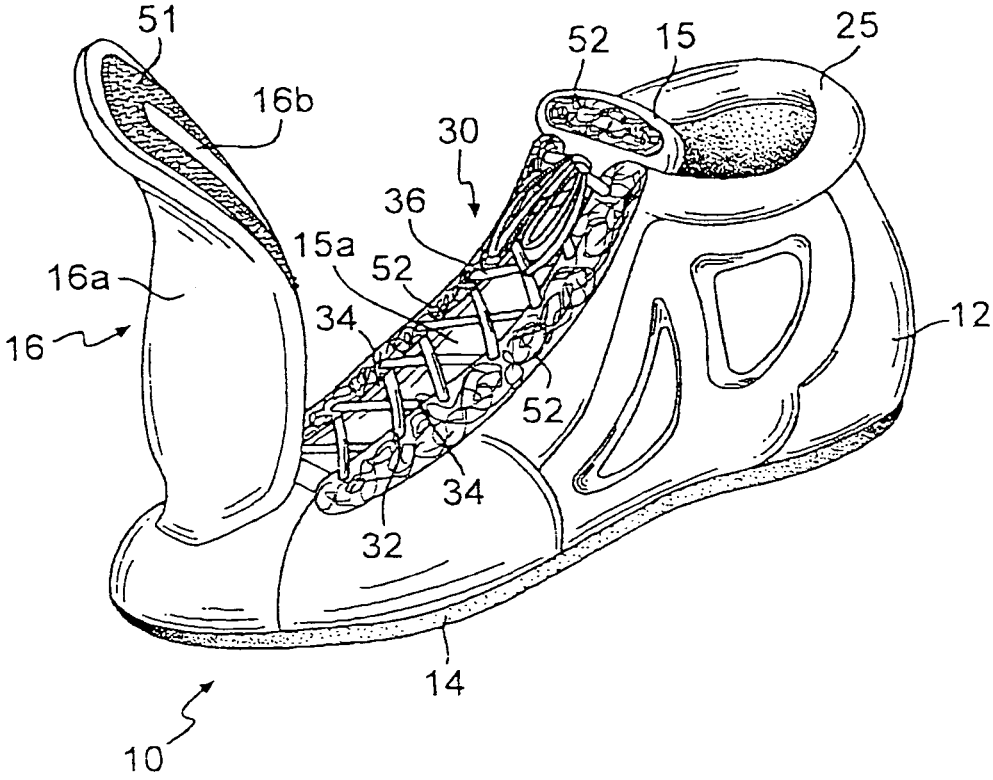
FIG. 4 is a perspective view of the padded shoe illustrated in FIG. 1 with the outer tongue portion shown in an outwardly extended position.

As can be seen in FIGS. 2–4, the padded tongue 18 may include an inner tongue portion 15 and an outer tongue portion 16. The inner and outer tongue portions 15, 16 include front surfaces 15*a*, 15*b* and back surfaces 16*a*, 16*b*. As shown in FIG. 3, both the inner and outer tongue portions 15, 16 preferably have padding material 22. In a particularly preferred embodiment, the inner tongue portion 15 has a greater amount of padding material 22 than the outer tongue portion 16. Either the inner tongue portion 15 or the outer tongue portion 16, or both, can extend above the upper edges 25 of shoe upper 12. Extending the inner tongue portion 15 or the outer tongue portion 16 above the shoe upper 12 can advantageously provide protective padding for the lower leg of the wearer.

FIG. 4 illustrates the outer tongue portion 16 in an outwardly extended position. It can be seen that the shoe upper 12 includes oppositely disposed free edges 34. The free edges 34 are positioned between the inner and outer portions 15, 16 of the padded tongue 18.

Any suitable fastening structure can be utilized that will secure the shoe 10 to the foot of the wearer, such as Velcro®. The shoe 10 preferably includes a fastening structure that can be selectively tightenable to maintain the shoe on the wearer's foot. The fastening structure can interconnect the free edges 34 to secure the shoe 10 to the foot of the wearer. The fastening structure is preferably positioned between the inner and outer portions 15, 16 of tongue 18. The fastening structure can include a conventional lacing area 30 having a row of eyelets 32 located on each of the oppositely disposed edge portions 34 of the shoe upper 12. A lace 36 can be inserted through the eyelets 32.

The shoe 10 preferably includes an engagement structure to secure the outer tongue portion 16 to the inner tongue portion 15 and/or the shoe upper 12. The engagement structure can be formed of synthetic material portions 51, 52 which adhere when pressed together, such as Velcro®. The material portions are preferably affixed to the back surface 16*b* of outer tongue 16 and at least one of the front surface 15*a* of inner tongue portion 15 and the area proximate to the opposing edges 34 of the shoe upper 12. In the illustrated embodiment, fastening material portion 51 is attached to the periphery of the back surface 16*b* of outer tongue 16, although the invention is not limited in that regard. The fastening material portions 52 are attached to the shoe upper 12 proximate to the opposing edges 34 and on the front surface 15*a* of inner tongue portion 15 so as to be in general alignment with fastening material portion 51. The fastening material portions 51, 52 can be attached by any suitable method, such as stitching or adhesives, and can be arranged in any suitable configuration. Alternatively, snaps formed from any suitable material can be utilized to secure the outer tongue portion 16, either alone or in combination with hook and loop fastening material described above. Any suitable method, or combination of methods, can be used to secure the outer tongue portion 16 to prevent movement of the outer tongue portion 16 relative to the shoe upper 12 while the shoe 10 is being worn by the wearer.

Figure 5:
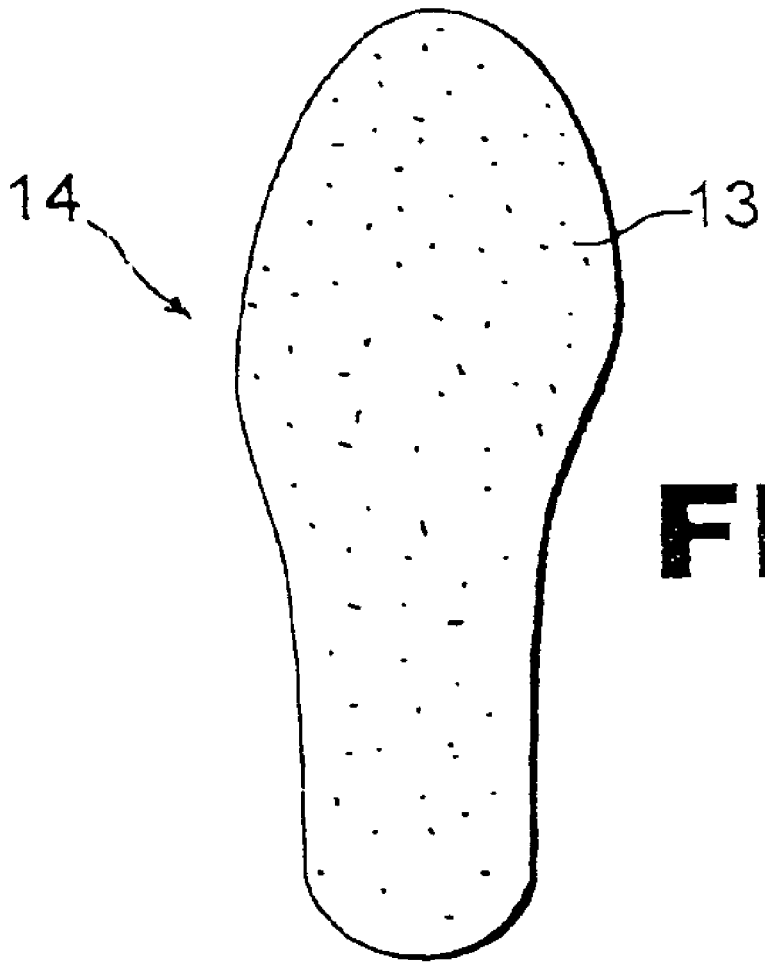
FIG. 5 is a bottom plan view of the padded shoe of FIG. 1.
Figure 6:
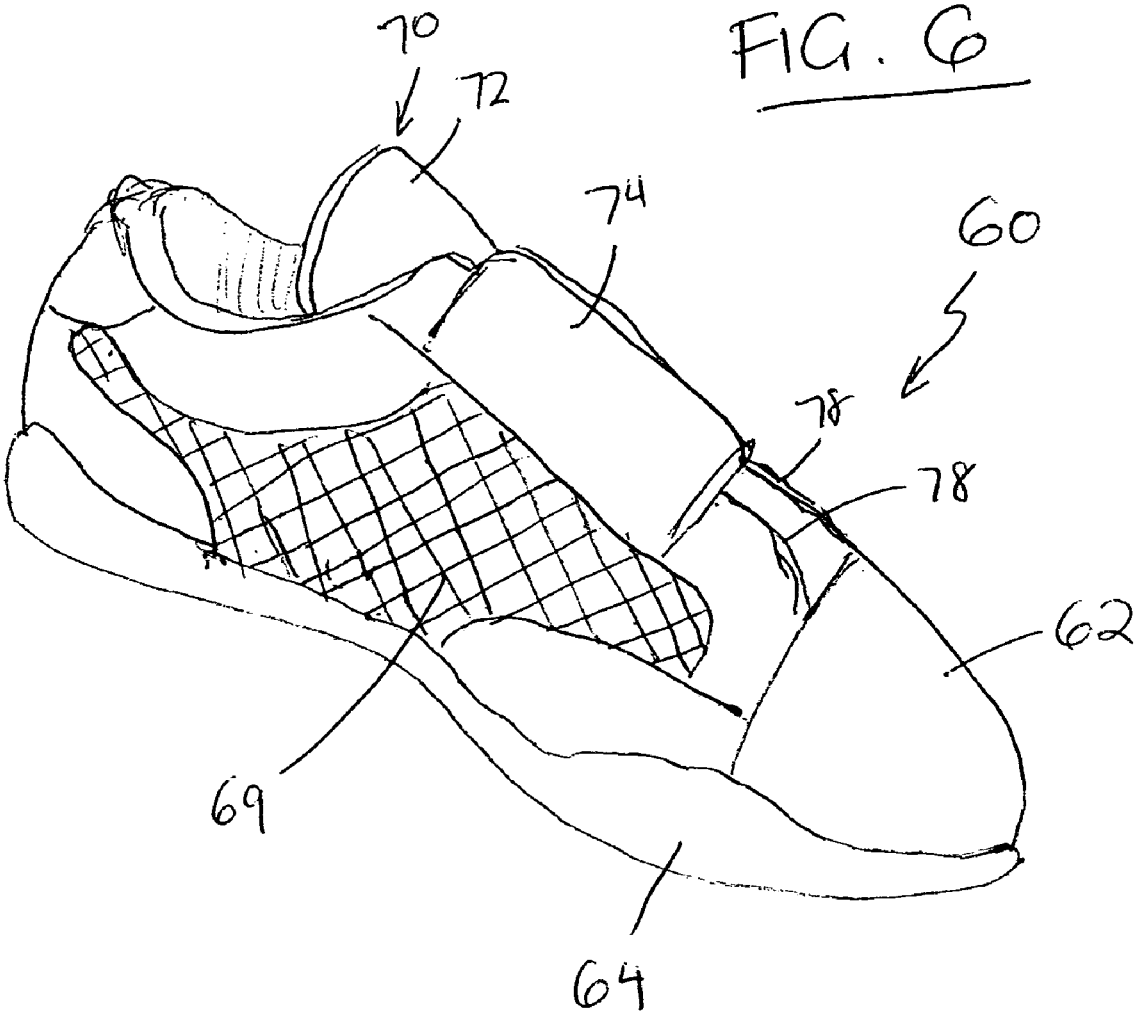
FIG. 6 is a left perspective view of a padded shoe according to a second embodiment of the invention.

The lower surface of sole 14 can have any suitable texture. FIG. 5 illustrates the lower surface 13 of the sole 14 having a smooth texture. The smooth texture allows the wearer to pivot on the balls of the feet on a flat surface, such as a gym floor, as would be done when practicing various martial arts sports. In sports such as kick boxing or karate, the bottom of the feet will strike the selected target, typically a kicking bag or a human opponent. Advantageously, the smooth texture of FIG. 5 is suitable for contact with both a floor surface and a human opponent or partner.

In one embodiment, the lower surface 13 of the sole 14 may be formed at least partly of crepe rubber. Advantageously, a crepe rubber sole is soft enough to reduce the likelihood of scraping or otherwise injuring a human opponent or partner who comes into contact with the sole, yet durable enough to allow the shoe to be worn on the street, as opposed to primarily on a gym floor. Alternatively, the sole may be formed of EVA.

As previously indicated, the shoe 10 provides advantages to the wearer when the wearer is engaged in activities which involve kicking, as the shoe 10 can have a limited number of protruding exterior features or sharp edges that could possibly injure an opponent. The padded tongue 18 provides protection to the top of the wearer's foot when this area is impacted, such as by kicking a bag or an opponent. The outer tongue portion 16 advantageously protects an opponent from impact with fastening structure, such as the knotted lace 36 of a preferred embodiment. The padding material in the inner tongue portion 15 further protects the top of the wearer's foot on impact from the lacing and knots in the lacing.

If the tongue of an athletic shoe slips to one side, the shoe can be uncomfortable for the wearer. The above-described arrangement of securing the outer tongue portion 16 to the inner tongue portion 15 and the shoe upper 12 also provides the advantage of maintaining the padded tongue 18 in an optimum center position, if desired.

A second embodiment of the padded shoe of the present invention is shown in FIGS. 6 to 9. The shoe 60 is preferably formed of materials which are light in weight yet still strong and durable. The shoe 60 includes a shoe upper 62 adjoined to a sole 64. The shoe upper 62 can be manufactured from any conventional material such as leather, synthetic leather, or plastic. The shoe upper 62 preferably extends at least to the ankle of the wearer, however, the invention is not limited in that regard. For example, the shoe upper 62 can extend significantly beyond the ankle of the wearer to cover all or a portion of the shin, or not extend to the ankle of the wearer. A separate shin pad (not shown) may be attachable to the shoe 60. An upper edge 66 of the shoe upper 62 preferably forms a collar into which a foot can be inserted.

A portion of the edge of sole 64 can be chamfered to provide a continuous arcuate edge at the point where the sole 64 is joined to the shoe upper 12. It is particularly preferable to have chamfered edges at the front toe and rear heel portions of the shoe 60. The sole 64 can be attached to the shoe upper 62 by any means known in the art, such as gluing, stitching, or heat sealing. Preferably, the shoe upper 62 is formed using a Strobel construction, and the sole 64 is then attached to the shoe upper 62. The Strobel construction involves stitching the shoe upper 62 to a flexible sole liner. In the Strobel construction, an insole board or other reinforcing material is absent from the shoe upper 62. The flexible lining and the shoe upper 62 may then be attached to the sole 64 by cementing, gluing, bonding or any other suitable means. This allows the sole to be flexible, which is desirable in the martial arts. Further, the shoe upper 62 preferably fits within a lip formed by the sole 64 so that there is a reduced chance for the upper to tear away from the sole in use. Preferably, the sole 64 is formed of a low density foam made of EVA (Ethylene Vinyl Acetate) resin with a durometer between 0.20 and 0.23. The sole can thus have resiliency to the touch, and can absorb some of the force of an impact.

The shoe upper 62 can include padding material 68 disposed therein. The padding material 68 preferably has a high degree of resiliency and excellent shock absorption properties. In a particularly preferred embodiment, the padding material 68 is a closed-cell chemically cross-linked polyethylene or polyolefin foam, such as the Minicel® products manufactured by the Voltek Division of the Sekisui America Corporation. The preferred closed-cell foams produced under the Minicel trademark include the L200, L300, L200F, L380, LS200, LS300, LS380, M200, M300, M380, MS200, MS300, MS380, T200, T300, TS200, TS300 and TS380 foams, which have excellent strength and shock absorption properties. In addition, these foams have a low degree of water absorption. Although not limited in this regard, closed-cell foam padding suitable for use in the shoe upper 62 preferably has a durometer of around 0.253. The preferred foams also have a density of between approximately 1.5 and 4.5 pcf, a compression strength of between approximately 3 and 23 psi at approximately 25% deflection and between approximately 9 and 42 psi at approximately 50% deflection, and a tensile strength of between 28 and 145 psi.

The padding material 68 can be located throughout the shoe upper 62 or only in certain areas of the shoe upper 62. In a particularly preferred embodiment, the padding material 68 has an increased thickness on those points of the shoe upper 62 which cover portions of the foot that are more likely to be injured during athletic activities involving kicking, such as kick boxing and martial arts. The padding may have a thickness of 0.375 inch, as an example. The padding material 68 may have an increased thickness at the portion of the shoe upper 62 that covers the forward dorsal region of the foot, the top of the foot, the posterior aspect of the heel, the left and right forward lateral aspects of the foot, and/or the ankle portion. The padding material 68 can have any suitable thickness, and may have a thickness of between 0.25 and 0.5 inches, such as 0.375 inch padding. The ankle area may be padded more thickly than other areas of the shoe. For example, the ankle area may have a closed-cell foam padding core of 0.375 inch thickness covered by an open-cell foam padding of 0.125 inch thickness. The open cell foam padding is softer for increased comfort, but the closed-cell foam padding offers more injury protection. Areas of the shoe upper 62 which are not thickly padded, such as the sides of the shoe upper 62 may be padded with any suitable thickness of padding, such as 0.125 inch, or may be replaced by an open mesh 69 to allow for added ventilation of the foot of the wearer.

The shoe 60 includes a padded tongue 70, which may include an inner tongue portion 72 and an outer tongue portion 74. Both the inner and outer tongue portions 72 and 74 preferably include padding material 68. The inner tongue portion 72 is preferably padded with closed-cell foam, and the outer padded tongue portion may be padded with either closed-cell or open-cell foam.

Figure 7:
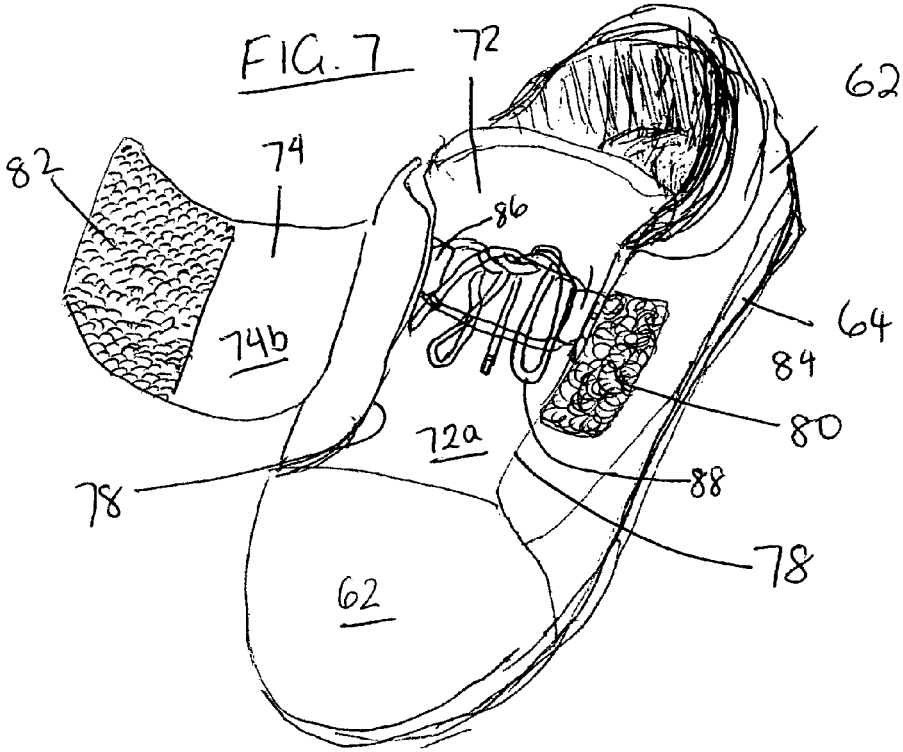
FIG. 7 is a right perspective view of the padded shoe of FIG. 6 with the outer tongue portion shown in an outwardly extended position.
Figure 8:
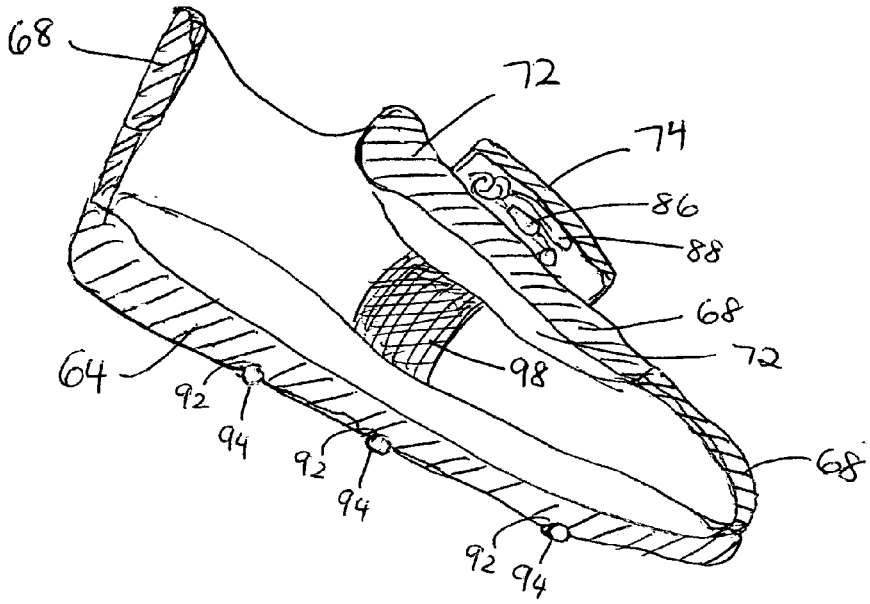
FIG. 8 is a cross-sectional view of the padded shoe of FIG. 6 taken along line 8—8.

FIG. 7 illustrates the outer tongue portion 74 in an outwardly extended position. It can be seen that the inner tongue portion 72 is attached at its base 76 to the shoe upper 62 and can extend over substantially all of the top of the foot to the ankle of a wearer. The shoe upper 62 includes oppositely disposed free edges 78. The free edges 78 are positioned between the inner and outer tongue portions 72 and 74, and extend over the inner tongue portion 72. The outer tongue portion 74 extends widthwise across the shoe. The outer tongue portion 74 can be attached to the shoe upper 62 at the medial side of the shoe. That is, on the left shoe, the outer tongue portion 74 can be attached to the shoe upper 62 at the right side of the shoe, and on the right shoe, the outer tongue portion can be attached to the shoe upper at the left side of the shoe.

The shoe 60 preferably includes an engagement structure to secure the outer tongue portion 74 to the inner tongue portion 72 and/or the shoe upper 62. The engagement structure can be formed of synthetic material portions 80 and 82 which adhere when pressed together, for example, the engagement structure may be formed by a hook and loop type fastener such as Velcro®. The material portions are preferably affixed to the back surface 74*b* of outer tongue 74 and at least one of an area proximate to one of the opposing edges 78 of the shoe upper 62 and a front surface 72*a* of the inner tongue portion 72. The fastening material portion 80 is attached to the shoe upper 62 proximate to one of the opposing edges 78 so as to be in general alignment with fastening material portion 82 when the outer tongue portion 74 is fastened over the inner tongue portion 72. The fastening material portions 80 and 82 can be attached by any suitable method, such as stitching or adhesives, and can be arranged in any suitable configuration. Any suitable method, or combination of methods, can be used to secure the outer tongue portion 74 to prevent movement of the outer tongue portion 74 relative to the shoe upper 62 while the shoe 60 is being worn by the wearer.

Any suitable fastening structure can be utilized that will secure the shoe 60 to the foot of the wearer. The shoe 60 may include a fastening structure that can be selectively tightenable to maintain the shoe on the wearer's foot. The fastening structure can interconnect the free edges 78 to secure the shoe 60 to the foot of the wearer. The fastening structure is preferably positioned between the inner and outer portions 72 and 74 of tongue 70. The fastening structure can include conventional laces 84 having at least one eyelet or loop 86 located on each of the oppositely disposed edge portions 78 of the shoe upper 62. A lace 88 can be inserted through the loops 86. Alternatively, the shoe may be held in position on a foot of a wearer by the outer tongue portion 74 alone.

Figure 9:
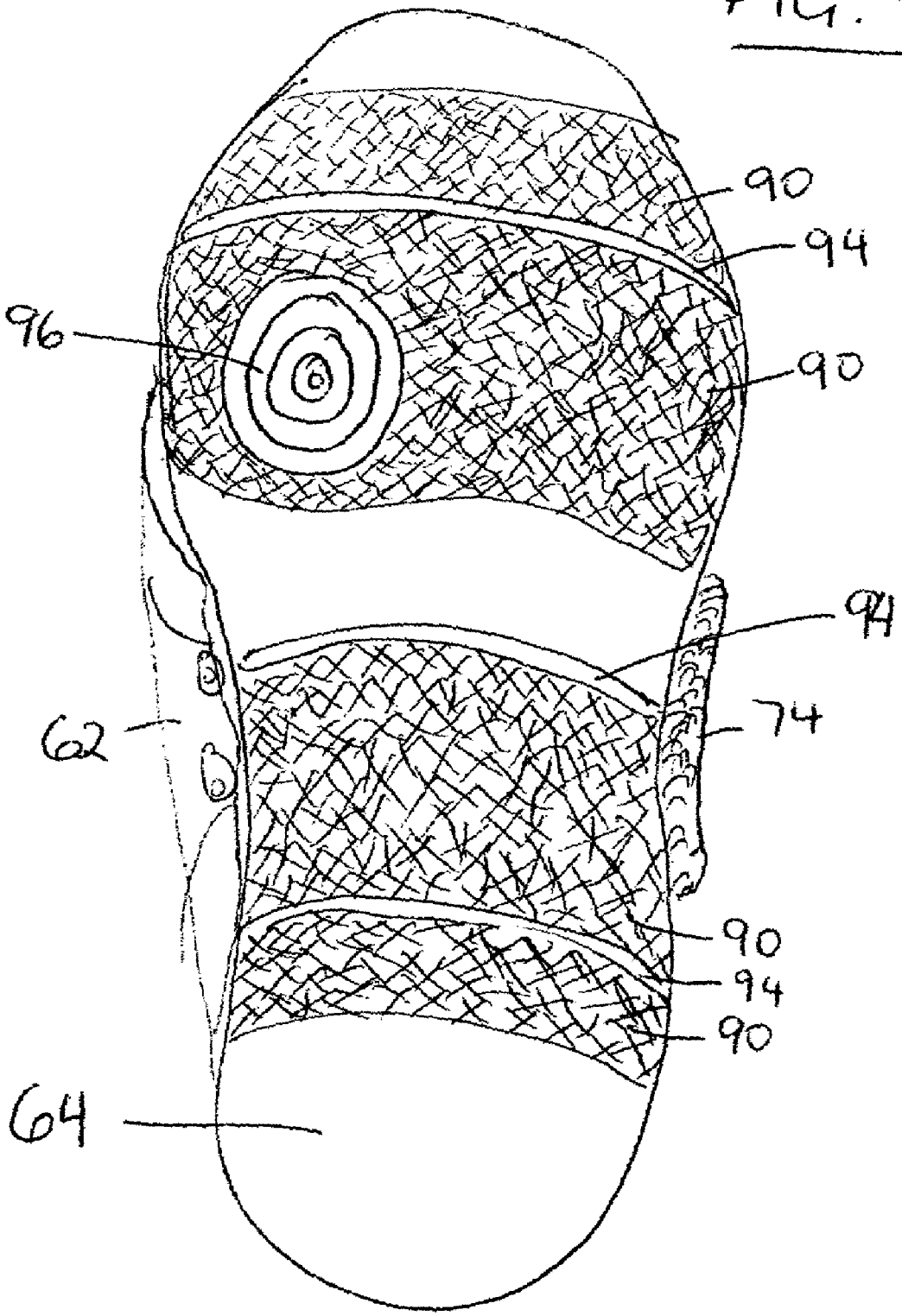
FIG. 9 is a bottom plan view of the padded shoe of FIG. 6.

The sole 64 may be generally smooth with substantially no protrusions such as cleats, ridges, or indentations. It will be appreciated that some slight variation in the surface of the sole such as surface patterning or even small ridges, bumps and/or roughening may be provided on the sole 64. Such an arrangement may provide certain advantages, such as preventing a wearer from slipping on a gym floor and providing a surface of the sole 64 that is smooth enough to prevent injuries, and particularly facial injuries, to an opponent receiving a kick from a person wearing the shoe. The area of the sole 64 underneath the arch of a wearer may be indented so that some small raised or indented features such as the shoe size and the manufacturer's logo may be included without departing from the substantially smooth nature of the area of the sole 64 that will generally contact another surface or an opponent. The smooth sole allows the wearer to pivot on the balls of the feet on a flat surface, such as a gym floor, as would be done when practicing various martial arts. In sports such as kick boxing or karate, the bottom of the feet will strike the selected target, typically a kicking bag or a human opponent. Advantageously, the smooth texture of the sole 64 is suitable for contact with both a floor surface and a human opponent or partner without causing serious injury to the human opponent. FIG. 9 illustrates a possible texture of the lower surface of sole 64, although the invention is not limited to the textures described or shown. The sole 64 may have a surface pattern 90 that may be shallowly indented into the surface of the sole 64 to prevent the sole 64 from slipping on the floor of a gym or the like. In addition, the sole 64 may have grooves 92 that may contain gripping areas or extrusions 94. The gripping extrusions 94 may be formed of a softer material than the rest of the sole 64. A pivot point 96 of the same material as the gripping extrusions 94 may also be provided. Alternatively, the gripping areas 94 and the pivot point 96 may be created by indentations in the sole 64. The sole 64 may be formed of EVA. In a preferred embodiment, the sole 64 may be flexible, and may have a durometer of 0.2 to 0.23.

Stretchable straps 98 may be provided on each side of the inner foot area of the shoe 60 to secure the inner tongue portion 72 to the sole 64 in order to properly retain the inner tongue portion 72 in place on the foot of a wearer. The straps 98 may be formed of any suitable material, such as elastic.

As previously indicated, the shoe 60 shown in FIGS. 6 to 9 provides advantages to the wearer when the wearer is engaged in activities which involve kicking, as the shoe 60 can have a limited number of protruding exterior features or sharp edges that could possibly injure an opponent. The inner padded tongue portion 72 provides protection to the top of the wearer's foot when this area is impacted, such as by kicking a bag or an opponent. The outer padded tongue portion 74 advantageously protects an opponent from impact with fastening structure, such as a knotted lace 80.

Figure 10:
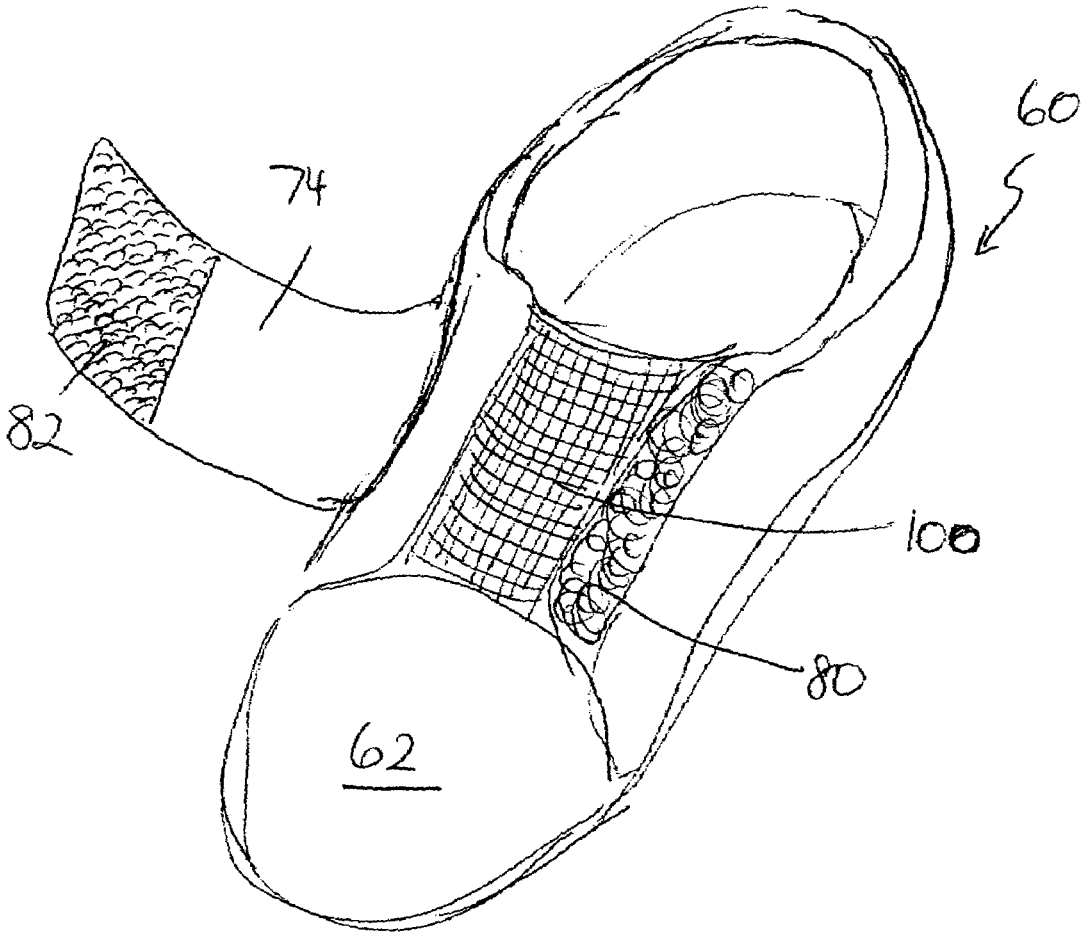
FIG. 10 is a perspective view of a padded shoe according to a further embodiment of the invention.

In another embodiment of the invention, illustrated in FIG. 10, there is no padded inner tongue portion 72, nor straps 98. Instead, the inner tongue portion is formed by a stretchable material portion 100 which extends between the opposing edges 78 of the shoe upper 62. The stretchable material portion 100 may be formed of any suitable material, such as elastic. The stretchable material portion 100 helps maintain the shoe 60 on the foot of a wearer without the need for additional fastening elements. In this embodiment, the padding in the outer tongue portion 74 can be thinner than in the other embodiments, in order to provide sufficient injury protection to the foot of the wearer. Other features of the shoe are similar to the embodiment shown in FIGS. 6-9 and will not be further described.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

What is claimed is:

1. A padded shoe, comprising:

a flexible, resilient sole having a generally smooth outer surface;

a shoe upper adjoined to the sole, wherein at least a portion of said shoe upper has closed-cell foam padding disposed therein;

said shoe upper comprising a padded tongue, wherein said padded tongue comprises an inner padded tongue portion and an outer padded tongue portion;

fastening structure to retain the shoe on the foot of a wearer; and engagement structure for securing said outer padded tongue to cover said inner padded tongue portion, said outer padded tongue portion substantially covering said engagement structure, whereby the wearer can strike a target with said shoe, and the target and the wearer are protected from injury caused by direct impact with said fastening structure and said engagement structure.

2. The padded shoe of claim 1, wherein the outer tongue portion is attached to the shoe upper at one side of the shoe.

3. The padded shoe of claim 1, wherein the outer tongue portion is attached to the shoe upper at an end of the tongue.

4. The padded shoe of claim 1, wherein the outer padded tongue portion has closed-cell foam padding disposed therein.

5. The padded shoe of claim 1, wherein the inner padded tongue portion has closed-cell foam padding disposed therein.

6. The shoe of claim 1, wherein the shoe upper is completely padded.

7. The shoe of claim 1, wherein the shoe upper comprises padding to generally correspond to at least one location on the foot of the wearer, said location including at least one of the group consisting of the forward dorsal region, the top of the foot, the posterior aspect of the heel, the left and right forward lateral aspects of the foot, and the ankle portion.

8. The shoe of claim 1, wherein the closed-cell foam padding in the shoe upper has a durometer of approximately 0.253.

9. The shoe of claim 1, wherein the closed-cell foam padding in the shoe upper has a density of between approximately 1.5 pcf and approximately 4.5 pcf.

10. The shoe of claim 1, wherein the closed-cell foam padding in the shoe upper has a density of between approximately 1.5 pcf and approximately 3.5 pcf.

11. The shoe of claim 1, wherein the closed-cell foam padding in the shoe upper has a compression strength of between approximately 3 psi and approximately 23 psi at approximately 25% deflection and a compression strength of between approximately 9 psi and approximately 42 psi at approximately 50% deflection.

12. The shoe of claim 1, wherein the closed-cell foam padding in the shoe upper has a compression strength of between approximately 6 psi and approximately 22 psi at approximately 25% deflection and a compression strength of between approximately 12 psi and approximately 34 psi at approximately 50% deflection.

13. The shoe of claim 1, wherein the closed-cell foam padding in the shoe upper has a tensile strength of between approximately 28 psi and approximately 145 psi.

14. The shoe of claim 1, wherein the closed-cell foam padding in the shoe upper has a tensile strength of between approximately 30 psi and approximately 120 psi.

15. The shoe of claim 1, wherein the padding in the shoe upper has a thickness between approximately 0.125 inch and approximately 1 inch.

16. The shoe of claim 1, wherein the padding in the shoe upper has a thickness between approximately 0.25 inch and approximately 0.5 inch.

17. The shoe of claim 1, wherein the padding in the shoe upper has a thickness of approximately 0.375 inch.

18. The shoe of claim 1, wherein at least a portion of the sole has a surface pattern thereon.

19. The shoe of claim 1, wherein at least a portion of the perimeter of the sole is chamfered.

20. The shoe of claim 17, wherein the chamfering provides a smooth arcuate edge to said sole.

21. The shoe of claim 1, wherein the sole is formed at least partially from EVA.

22. The shoe of claim 1, wherein the sole has a durometer between approximately 0.20 and approximately 0.23.

23. The shoe of claim 1, wherein the fastening structure comprises a lace threaded through eyelets disposed on said shoe upper.

24. The shoe of claim 1, wherein the engagement structure comprises hook and loop fastener material positioned on at least a portion of an underside of the outer tongue portion.

25. The shoe of claim 1, wherein the inner tongue portion comprises an elastic material, said elastic material also comprising the fastening structure.

26. The shoe of claim 1, wherein the shoe upper is formed using a Strobel construction.

* * * * *